United States Patent [19]

Sisk

[11] 4,313,307

[45] Feb. 2, 1982

[54] HEATING AND COOLING SYSTEM AND METHOD

[75] Inventor: Francis J. Sisk, Apollo, Pa.

[73] Assignee: Electric Power Research Institute, Inc., Palo Alto, Calif.

[21] Appl. No.: 44,684

[22] Filed: Jun. 1, 1979

Related U.S. Application Data

[63] Continuation of Ser. No. 832,283, Sep. 12, 1977, abandoned.

[51] Int. Cl.[3] ..... F25B 7/00; F25B 27/02

[52] U.S. Cl. ..... 62/79; 62/238.6; 62/243; 62/277; 62/324.5

[58] Field of Search ..... 62/238 E, 239, 243, 62/244, 324 D, 79, 452, 453, 277, 278, 256; 165/63

[56] References Cited

U.S. PATENT DOCUMENTS

| | | | |
|---|---|---|---|
| 2,418,446 | 4/1947 | Anderson | 62/238 E |
| 2,706,387 | 4/1955 | Swanson | 62/277 X |
| 3,371,503 | 3/1968 | Perez | 62/277 X |
| 3,589,437 | 6/1971 | Shoji et al. | 62/324 D |
| 3,719,058 | 3/1973 | Waygood | 62/243 |
| 3,732,703 | 5/1973 | Nordstrom et al. | 62/324 D |
| 3,850,006 | 11/1974 | Redfern et al. | 62/243 |
| 3,916,638 | 11/1975 | Schmidt | 62/238 R |
| 3,922,876 | 12/1975 | Wetherington, Jr. et al. | 62/238 R |
| 3,926,008 | 12/1975 | Webber | 62/238 E |
| 3,976,123 | 8/1976 | Davies | 62/238 E |
| 3,989,183 | 11/1976 | Gustafsson | 62/238 E |
| 4,089,667 | 5/1978 | Jonsson | 62/238 E |
| 4,100,763 | 7/1978 | Brody | 62/324 D |
| 4,142,381 | 3/1979 | Lavigne, Jr. | 62/238 E |

*Primary Examiner*—Lloyd L. King

*Attorney, Agent, or Firm*—Flehr, Hohbach, Test, Albritton & Herbert

[57] ABSTRACT

A vapor compression heating/cooling system and method of operation having improved Coefficient of Performance and Capacity. Post-condenser liquid is cooled in a subcooler coil by a stream of air. One embodiment provides a warming machine or heat pump in which the condenser coil is within a volume to be warmed and the evaporator coil is on the outside exposed to ambient air. A stream of ambient air is pumped in heat exchange relationship with the subcooler coil to recover and expel heat from the coil into the volume. Where the volume comprises the interior of a house or other building structure the stream of air from the subcooler creates an over pressure within the volume to minimize infiltration of ambient air. In another embodiment the system is employed for refrigerating a volume such as a reefer trailer or other mobile compartment. The evaporator coil is within the compartment and the condenser coil is outside the compartment exposed to ambient air. A stream of air from the compartment is directed by a duct in heat exchange relationship with the subcooler coil and thence to ambient for expelling heat from the post-condenser liquid.

3 Claims, 2 Drawing Figures

HEATING AND COOLING SYSTEM AND METHOD

This is a continuation of application Ser. No. 832,283 filed Sept. 12, 1977, now abandoned.

BACKGROUND OF THE INVENTION

This invention relates in general to vapor compression heating and refrigerating systems. In particular the invention relates to heat pumps and refrigerating machines for respectively heating or cooling a volume.

A major element of lost work in vapor compression machines such as heat pumps and air conditioners is the loss due to throttling the condenser liquid to the evaporator. The Coefficient of Performance (COPH) of such a system is in accordance with the equation:

$$COPH=(h_b=h_e)/(h_c-h_b)$$

where $h_c$=enthalpy of superheated vapor after compression and $h_b$=enthalpy of vapor after heated in evaporator and entering the compressor and $h_e$=enthalpy of condensed liquid after cooling in condenser From the formula it is seen that the COPH is increased for either a warming or cooling machine by extracting heat from the condensed liquid. Where subcooling of post-condenser liquid is accomplished without affecting compression work then there is a gain in useful heating or cooling effect with a resulting increase in COPH and Capacity.

The described low temperature heating acquisition is even more beneficial to COPH than would be the effect of reversably expanding the liquid and applying the expansion work to reduce the net compression work. An example would be a heat pump evaporating at 5° F. and condensing at 100° F. with a compression efficiency of 55% and condenser subcooled to 85° F. resulting in a COPH of about 3.2. A reversible liquid expander from 85° F. to 15° F. would return about 5% of the compression gross work and increase the COPH to about 3.45, while subcooling from 85° F. to 15° F. usefully would increase the Capacity about 19.4% and raise the COPH to about 3.85. A problem which exists in applying these concepts to heat pump systems is that of providing a useful heating load of below 70° F.

In houses and other building structures a major component of heat loss amounting to about 20% to 40% comprises infiltration of the heating load from ambient. This results when the inside air of about 70° F. is replaced with cold ambient air which leaks into the structure as the air is driven by stack effect and wind.

OBJECTS AND SUMMARY OF THE INVENTION

It is a general object of the invention to provide a vapor compression heating/cooling system and method of operation having increased COPH and Capacity.

Another object is to provide a system and method of the type described in which post-condenser liquid is cooled for increasing COPH and Capacity.

Another object is to provide a system of the type described incorporating a warming machine or heat pump in which ambient air is employed for subcooling the post-condenser liquid with the heated air then being introduced into the volume being warmed.

Another object is to provide a heat pump system for a home or other inhabited enclosure in which ambient air is pumped in heat exchange relationship with a subcooler coil and into the enclosure to create an over pressure which minimizes infiltration by ambient air.

Another object is to provide a system of the type described for refrigerating an enclosure in which cold air within the enclosure is directed in heat exchange relationship with a subcooler coil for extracting heat and expelling the heat to ambient.

The invention in summary comprises a system and method of operation of a refrigerating or warming machine in which heat is respectfully extracted from or introduced into a volume. A working fluid is compressed and then condensed by ambient air for the refrigerating machine or with gas within the volume for the warming machine. Post-condenser liquid is then subcooled with gas from the volume for the refrigerating machine or with ambient air for the warming machine. The subcooled liquid is expanded for cooling gas in the volume for the refrigerating machine or the expanded gas is heated with ambient air for the heating machine. In the heat pump embodiment for heating a house a stream of ambient air for subcooling the liquid is pumped into the house to create an over pressure for minimizing infiltration of outside air. In the embodiment for refrigerating a mobile compartment a duct directs inside air for subcooling in a path which exits from the enclosure in a direction counter the direction of movement to assist in withdrawing the subcooling gas.

The foregoing and additional objects and features of the invention will appear from the following description in which the several embodiments had been set forth in detail in connection with the accompanying drawings.

DESCRIPTION OF THE PREFERRED EMBODIMENTS

Figure 1:
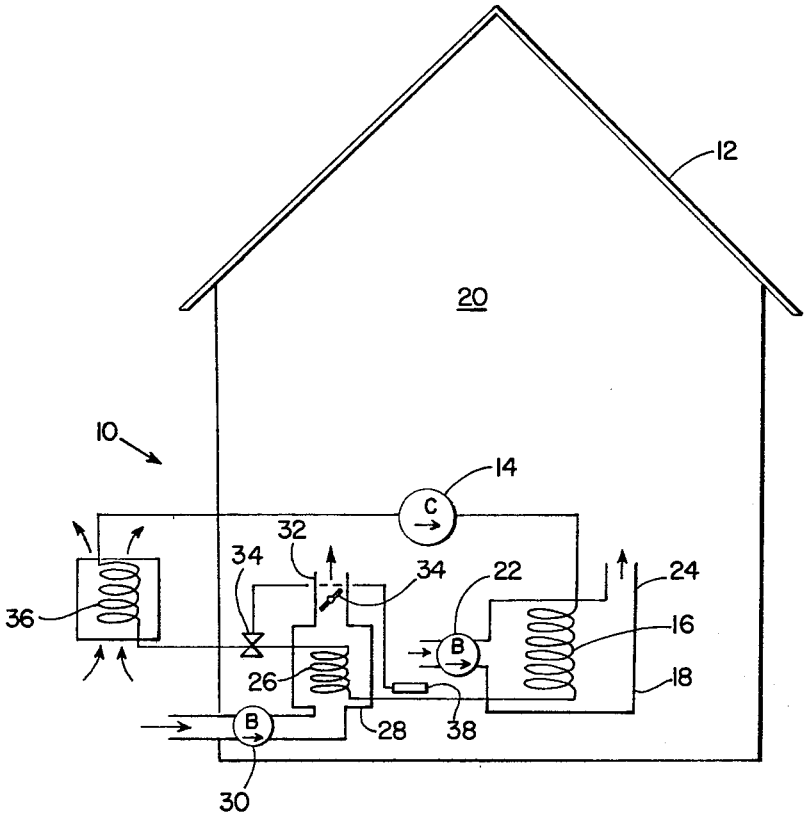
FIG. 1 is a schematic drawing of a warming machine embodiment of the invention shown in use as a heat pump for a house.

In the drawings FIG. 1 illustrates generally at 10 a warming machine embodiment of the invention comprising a heat pump for heating the inside volume of a house 12. The heat pump comprises a vapor compression machine including a compressor 14 which compresses a suitable working vapor such as R22 refrigerant, a trademark for the flourinated hydrocarbon having the formula $CHClF_2$. The compressed vapor is directed into condenser coil 16 mounted in a housing 18 within the volume 20 to be warmed. A blower 22 pumps inside air into the housing in heat exchange relationship with coil 16 for cooling the vapor into a liquid. The air is heated by the coil and directed through outlet 24 into the volume.

Post-condenser liquid is directed into a subcooler coil 26 within housing 28. A blower 30 pumps ambient air through the inlet of the housing and in heat exchange relationship with the subcooler coil. The stream of air extracts heat from the post-condenser liquid and is directed through housing outlet 32 into the volume to be warmed. A control valve 34 is employed in the outlet for controlling the rate of subcooling air flow. The control valve can be manually set, or it could comprise a suitable thermostatic damper of the type conventionally used in refrigerator-freezers. Either type of damper would be adjusted to maintain a predetermined exit temperature of the subcooler air stream.

The ambient air pumped by blower 30 through the subcooler creates an over pressure within volume 20 relative to ambient air pressure. This over pressure serves to minimize infiltration or leakage of cold ambient air through the house structure. The over pressure level required would depend upon various factors including the extent of leakage openings in the structure and the wind velocity encountered at any particular time. Preferably the overpressure within the volume is at a level which is approximately equal to the windward side air pressure.

The blower 30 could also be eliminated by connecting a duct, not shown, between subcooling housing outlet 32 and the inlet of condenser blower 22 so that a single stream of ambient air is pumped by blower 22 through both the subcooler and condenser housings.

Liquid refrigerant from the subcooler coil is expanded through a throttling valve 34 into evaporator coil 36. Ambient air circulates in heat exchange relationship with the evaporator coil for transferring heat to the refrigerant. The rate of flow through the throttling valve is controlled by a suitable flow control of the sub-cooling type having a bulb 38 mounted on the condenser exit.

An example of the use and operation of the embodiment of FIG. 1 is as follows. Subcooler 26 comprises an aircooled liquid heat exchanger formed of a helical coil of bristle-fin tubing having approximately 50 square feet of air side surface for use with a nominal two ton heat pump. Blower 30 is rated at 50 cfm capacity.

During operation the vapor from compressor 14 is condensed into a liquid in coil 16 with the heat of condensation transferred to the air stream pumped by blower 22 through housing 18 and into the volume to be warmed. The post-condenser liquid is cooled in coil 26 by ambient air pumped by blower 30 into housing with 28 heat extracted from the liquid being carried by the air stream into the house. The liquid from the subcooler coil is expanded through throttling valve 34 into evaporator coil 36 where the relatively colder vapor is warmed by ambient air. Damper 34 is adjusted in accordance with outside wind conditions to deliver warmed ambient air from the outlet of the subcooler housing at a temperature on the order of 70° F. The over pressure within volume 20 created by pumping of the warmed ambient air resists infiltration of ambient air through the building structure. Increasing wind conditions will result in a requirement of increase air flow through the subcooler with a resulting drop in temperature of that air flow; however, the subcooling heat is fully utilized in suppressing infiltration loss when there is any windward side inflow. With inflow stopped the effectiveness of the subcooling heat is in the ratio of:

$$K=(70^\circ - T_{supply})/(70^\circ - T_{ambient})$$

It will be noted that the added subcooling heat is obtained at no energy cost into the system. Moreover, the equipment cost is relatively modest in that only a small subcooler heat exchanger, housing, damper and the optional blower, are provided. The subcooling heat will exceed approximately 20% of the base heat pump capacity on very cold days, and to a lesser percentage on milder days. The effectiveness of the subcooling heat is highest on windy days when added capacity is most needed.

Figure 2:
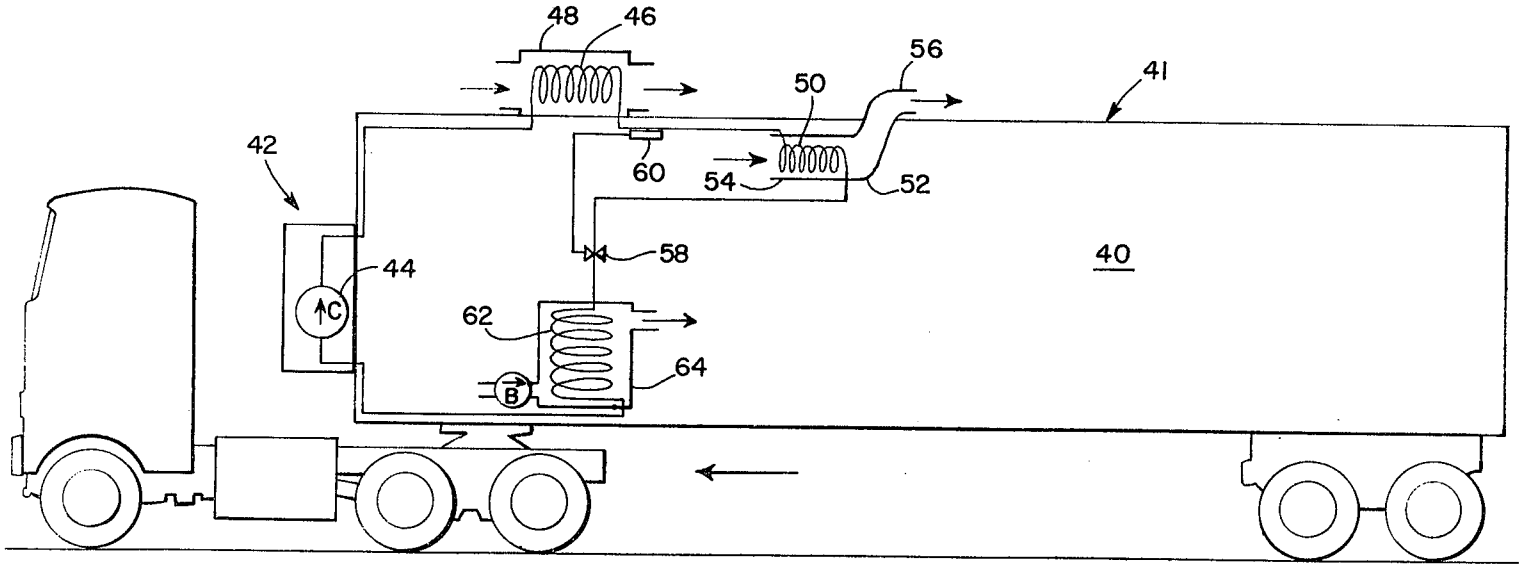
FIG. 2 is a schematic diagram of the refrigerating machine embodiment of the invention shown in use with a reefer trailer.

FIG. 2 illustrates another embodiment of the invention for use in refrigerating a volume. In this embodiment the refrigerated volume 40 comprises a mobile compartment, illustrated as a reefer trailer 41.

A vapor compression refrigerating machine 42 is provided on the trailer. The machine includes a compressor 44 which compresses a working fluid such as R22 refrigerant into a condenser coil 46 mounted within a housing 48 on the trailer roof. The housing is provided with inlet and outlet openings through which a stream of ambient air is directed during relative movement of the trailer. The ambient air cools the compressed vapor which is then directed into a subcooler coil 50 mounted in a duct 52 within the trailer volume. An inlet portion 54 of the duct concentrates a stream of escaping cold air from the trailer into heat exchange relationship with the subcooler coil. An outlet portion 56 of the duct projects through the trailer roof and discharges the air stream in a direction counter the direction of trailer movement. Forward movement of the trailer thereby creates a partial vacuum at the outlet to assist in drawing air through the duct.

Liquid from the subcooler is expanded through a throttling valve 58. Flow through the throttling valve is controlled by suitable means such as a sub-cooling type control having a bulb 60 mounted on the condenser exit. Vapor expands from valve 58 into an evaporator coil 62 mounted in a housing 64 within the trailer. A blower 66 pumps inside trailer air into the evaporator housing where it is cooled and then directed through outlet 68 back to the trailer volume.

In the use and operation of the embodiment of FIG. 2 the COPH and Capacity of the refrigerating machine is increased through subcooling of the post-condenser liquid by cold air from the trailer which otherwise would leak out due to the pressure of infiltrating air caused by motion of the trailer. In other words heat is extracted from the post-condenser liquid by causing a concentrated flow of escaping cold air (which is thereby warmed), the cooling effect of which would otherwise be lost due to such infiltration.

While the foregoing embodiments are presently considered to be preferred it is understood that numerous variations and modifications may be made therein by those skilled in the art and it is intended to cover in the appended claims all such variations and modifications as fall within the true spirit and scope of the invention.

What is claimed is:

1. A method of operating a compression-expansion cycle refrigerating machine for transferring heat from a volume of air within an enclosure to ambient air, the enclosure comprising a mobile refrigerating compartment, and the refrigerating machine including a condenser coil outside the enclosure, an evaporator coil within the enclosure and a subcooler coil connected in a series between the condenser coil and evaporator coil, including the steps of compressing a working fluid, transferring heat from the compressed fluid to the ambient air for condensing the fluid by directing a stream of relative moving ambient air in heat exchange relationship with the condenser coil during movement of the compartment, directing a stream of air for extraction from the volume within the enclosure to the ambient air in heat transfer relationship with the condensed fluid for transferring heat to the stream of air and for subcooling the condensed fluid, said air being extracted from the volume along a path in heat exchange relationship with the subcooler and thereafter to ambient air whereby heat extracted from the subcooled condensed fluid is expelled to ambient air, creating a partial vacuum by movement of the compartment relative to ambient air for extracting air from the compartment along said path in heat exchange relationship with the subcooler coil, reducing the pressure of the subcooled fluid to cause it to expand into a gas while undergoing a reduction in temperature, and transferring heat from the volume of air to the expanded gas with the heat from the subcooled condensed fluid being transferred to the stream of air directed to ambient air for increasing the Coefficient of Performance and Capacity of the refrigerating machine.

2. A vapor compression method for extracting heat from a volume of gas within an enclosure and transferring the heat to ambient air outside the enclosure, with the enclosure comprising a mobile compartment through which gas from the volume escapes during the movement of the compartment, including the steps of compressing a vapor of working fluid, transferring heat from the compressed fluid to the ambient air for condensing the fluid, subcooling the condensed fluid with a stream of gas directed along a path leading through the enclosure to ambient air, concentrating the escaping gas into said stream for movement within the enclosure along the path to ambient air with heat being transferred to the escaping gas for subcooling the condensed fluid to increase the Coefficient of Performance and Capacity in the vapor compression method, expanding the subcooled fluid into a vapor while causing the fluid to undergo a reduction in temperature, and transferring heat from the volume of gas to the expanded vapor.

3. A method of operating a compression-expansion cycle refrigerating machine for transferring heat from a volume of air within an enclosure to ambient air, the machine including a condenser coil outside the enclosure, an evaporator coil within the enclosure and a subcooler coil connected in series between the condenser coil and evaporator coil, including the steps of compressing a working fluid, transferring heat from the compressed fluid to the ambient air for condensing the fluid, directing a stream of air from the volume within the enclosure along a path in heat exchange relationship with the subcooler coil and thereafter to ambient air for transferring heat to the stream of air and for subcooling the condensed fluid whereby heat extracted from the subcooled condensed fluid is expelled to ambient air, reducing the pressure of the subcooled fluid to cause it to expand into a gas while undergoing a reduction in temperature, and transferring heat from the volume of air to the expanded gas with the heat being transferred from the subcooled condensed fluid to the stream of air increasing the Coefficient of Performance and Capacity of the refrigerating machine.

* * * * *